US005815856A

United States Patent [19]

Dore

[11] Patent Number: 5,815,856

[45] Date of Patent: Oct. 6, 1998

[54] PROTECTIVE MAT FOR SINKS AND COUNTERS

[76] Inventor: Steven P. Dore, 5941 N. Gulley, Dearborn Heights, Mich. 48127

[21] Appl. No.: 772,018

[22] Filed: Dec. 19, 1996

[51] Int. Cl.[6] ..... A47K 17/00

[52] U.S. Cl. ..... 4/657; 4/654

[58] Field of Search ..... 4/657, 655, 654, 4/658, 580, 581, 582, 583, 659

[56] References Cited

U.S. PATENT DOCUMENTS

| | | |
|---|---|---|
| D. 172,450 | 5/1954 | Timmons . |
| D. 193,090 | 6/1962 | Kraines . |
| 1,544,430 | 2/1925 | Brown . |
| 2,586,612 | 2/1952 | Caldwell . |
| 2,635,252 | 12/1953 | Gerue . |
| 4,106,133 | 8/1978 | Roberts . |
| 4,351,073 | 9/1982 | Elsas . |
| 5,279,007 | 1/1994 | Kolada . |

*Primary Examiner*—David J. Walczak

[57] ABSTRACT

A soft pliable mat includes a central rectangular base for covering the floor of a sink or basin. Four rectangular flaps extend from each side of the base to cover the sink or basin sidewalls as well as the upper surrounding edges and adjoining counter tops, as well as any rear splash board or front cabinet face. The liner may be formed from a planar stamping and formed into a generally closed-bottomed, open-topped receptacle through the use of fasteners such as hook and loop type fabric fasteners.

19 Claims, 4 Drawing Sheets

FIG 5
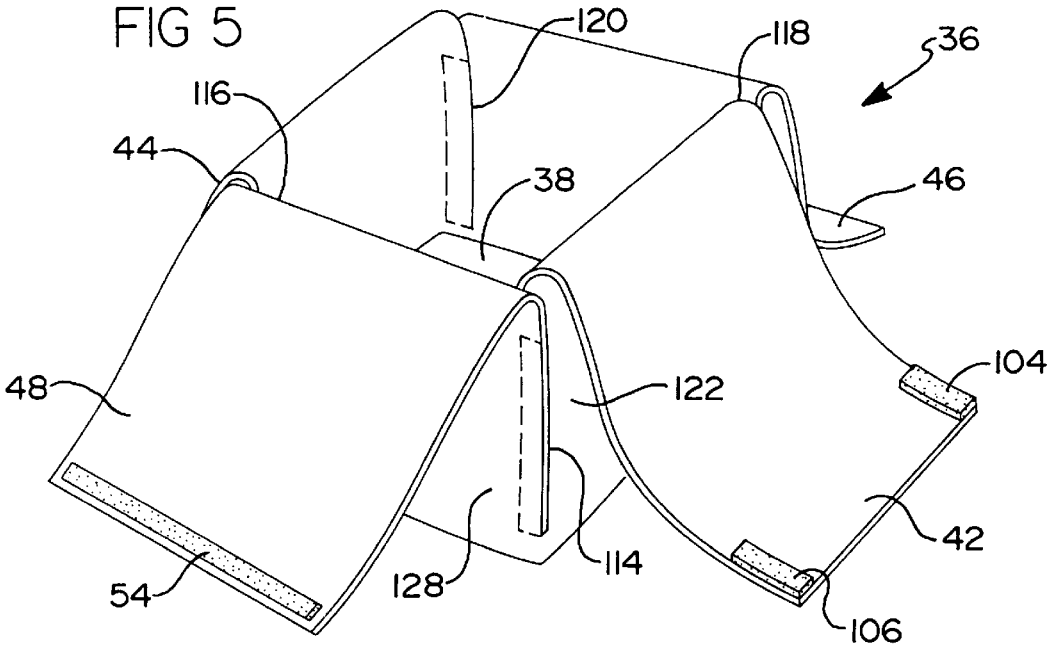
FIG 6
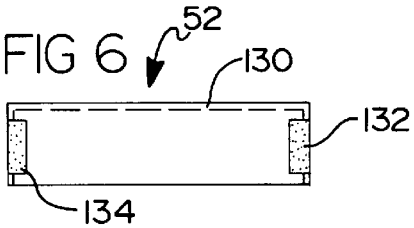
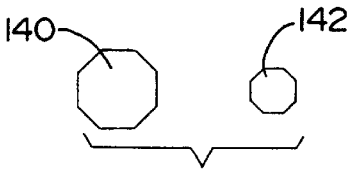
FIG 8
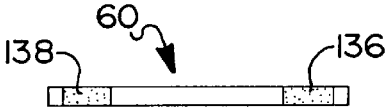
FIG 7
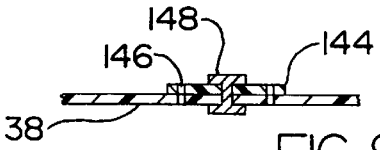
FIG 9
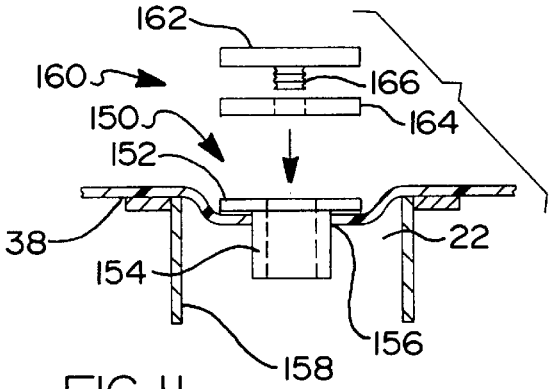
FIG 11
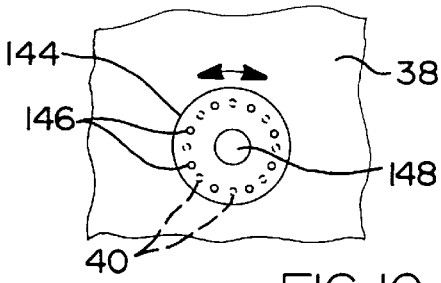
FIG 10

PROTECTIVE MAT FOR SINKS AND COUNTERS

BACKGROUND OF THE INVENTION

1. Field of the Invention

The present invention relates in general to a mat for covering the surfaces of sinks, basins and surrounding counter areas and relates in particular to a cross-shaped plastic or rubber mat which includes a central rectangular base from which extend four shape-conforming pliable flaps dimensioned to extend over adjoining counter tops.

2. Description of Prior Developments

Sink mats have been available for many years in numerous configurations for protecting sink floors and sidewalls from denting, chipping and abrasion. Although these prior designs perform adequately, they offer virtually no protection for the surrounding counter tops which are also subject to wear and abuse.

For example, when a sink is used to clean paint brushes, assorted painting hardware is generally assembled around the sides of the sink. Such hardware can not only gouge, scratch or abrade the surrounding counter tops but can also stain the same with wet paint. In a similar manner, when potting or repotting plants, various garden tools are assembled around the top of the sink as a home gardener manipulates pots, soil and plants within the sink. It can be appreciated that in almost any household application wherein a sink is used for containing the mess associated with such a project, not only the sink but the surrounding counter areas are subject to damage.

A particular problem arises when items subject to rust are left in and around the sink for extended periods. The result is usually a rust stain which is difficult if not impossible to remove.

Accordingly, a need exists for a sink mat or liner which not only protects the sink from excessive wear and tear but provides similar protection for the surrounding counter tops. For example, such additional protection is particularly appreciated when a home mechanic disassembles an automotive assembly in a sink, surrounds the counter top with heavy greasy tools having sharp edges and works on the counter with greasy hands.

A further need exists for such a protective mat which provides an extended area of counter top protection yet which may be stored in a very convenient and compact form.

Still another need exists for a sink mat which provides extensive surface area protection by conforming closely to the contours of a sink as well as the surrounding counter tops and splash boards, yet which may be simply and economically fabricated from a sheet of inexpensive plastic or rubber.

A further needs exists for a protective mat for a sink and its surrounding counter areas which not only anchors and maintains the liner in secure position within the sink itself, but also secures one or more flaps which extend over the adjacent counter top surfaces and counter front in a fixed position which resists movement or displacement.

A still further need exists for such a sink protective liner which provides a releasable mounting surface for wash rags and towels.

SUMMARY OF THE INVENTION

The present invention has been developed to fulfill the needs noted above and therefore has as a primary object the provision of a pliable protective sink liner which includes a plurality of flaps which extend up and over the edges of a sink so as to provide protection for the surrounding counter top and counter front.

Another object of the invention is to provide a sink liner which may be fabricated from a single sheet of pliable waterproof material, such as vinyl, plastic or rubber.

Yet another object of the invention is to provide a sink liner which not only readily conforms to the contours of a sink but also conforms to the contours of the surrounding counter tops and splash boards.

Still another object of the invention is to provide a sink liner which not only self centers itself within a sink and maintains itself in proper alignment within the sink but also includes additional means for securely positioning protective counter flaps in place.

Still another object of the invention is to provide a sink liner which includes a mounting surface for detachably mounting wash rags and towels to the liner.

Another object of the invention is to provide a sink liner which may accommodate various drain patterns or drain locations found in different sinks.

These and other objects are met by the present invention which is directed to a sink liner which includes a central rectangular base which is dimensioned to cover the bottom or floor surface of a sink or basin. A pliable protective flap extends perpendicularly from each side of the rectangular base and is dimensioned to not only cover the respective sidewall over which it is positioned but also to extend up and over the top edge of the sink and extend for a significant distance over the adjoining counter top and counter front, as well as the rear splash board. Although each flap can be individually assembled to the central base, a unitary one-piece stamping can be used to form the entire liner.

A slit is formed adjacent each corner of the central base at its point of intersection with the side flaps. The slits facilitate the folding of a pair of opposed side flaps over the front edge of the other pair of side flaps so as to form a generally rectangular open-topped receptacle from which each top edge extends a portion of a side flap.

Fasteners such as hook and loop connector strips of the type sold under the brand Velcro® may be used to secure the lower edges of each adjacent side flap to one another so as to maintain the liner in the configuration of a generally open-topped rectangular box.

Additional fasteners such as snaps or Velcro® strips may be provided along the outer edges or outer sides of the flaps for receiving weighted retainers such as ballast bags for holding the respective flaps in a desired selected position on an adjacent counter top. Moreover, a Velcro®-type connecting strip may be provided along the entire free end of one or more of the protective flaps for removably mounting a wash rag or towel thereto.

The aforementioned objects, features and advantages of the invention will, in part, be pointed out with particularity, and will, in part, become obvious from the following more detailed description of the invention, taken in conjunction with the accompanying drawings, which form an integral part thereof.

BRIEF DESCRIPTION OF THE DRAWINGS

In the drawings:

FIG. 5 is a perspective view of the liner of FIGS. 2–4 with the side flaps hanging freely;

FIG. 6 is a top plan view of a ballast bag constructed in accordance with the invention;

FIG. 7 is a top plan view of a connector strip formed in accordance with the invention;

FIG. 8 is a view in top plan of a pair of drain plugs formed in accordance with one embodiment of the invention;

FIG. 9 is a sectional view through another drain plug design constructed in accordance with the invention;

FIG. 10 is a top plan view of FIG. 9;

FIG. 11 is a view in partial section through another drain plug design in accordance with the present invention.

In the various figures of the drawings, like reference characters designate like parts.

DETAILED DESCRIPTION OF THE PREFERRED EMBODIMENTS

Figure 1:
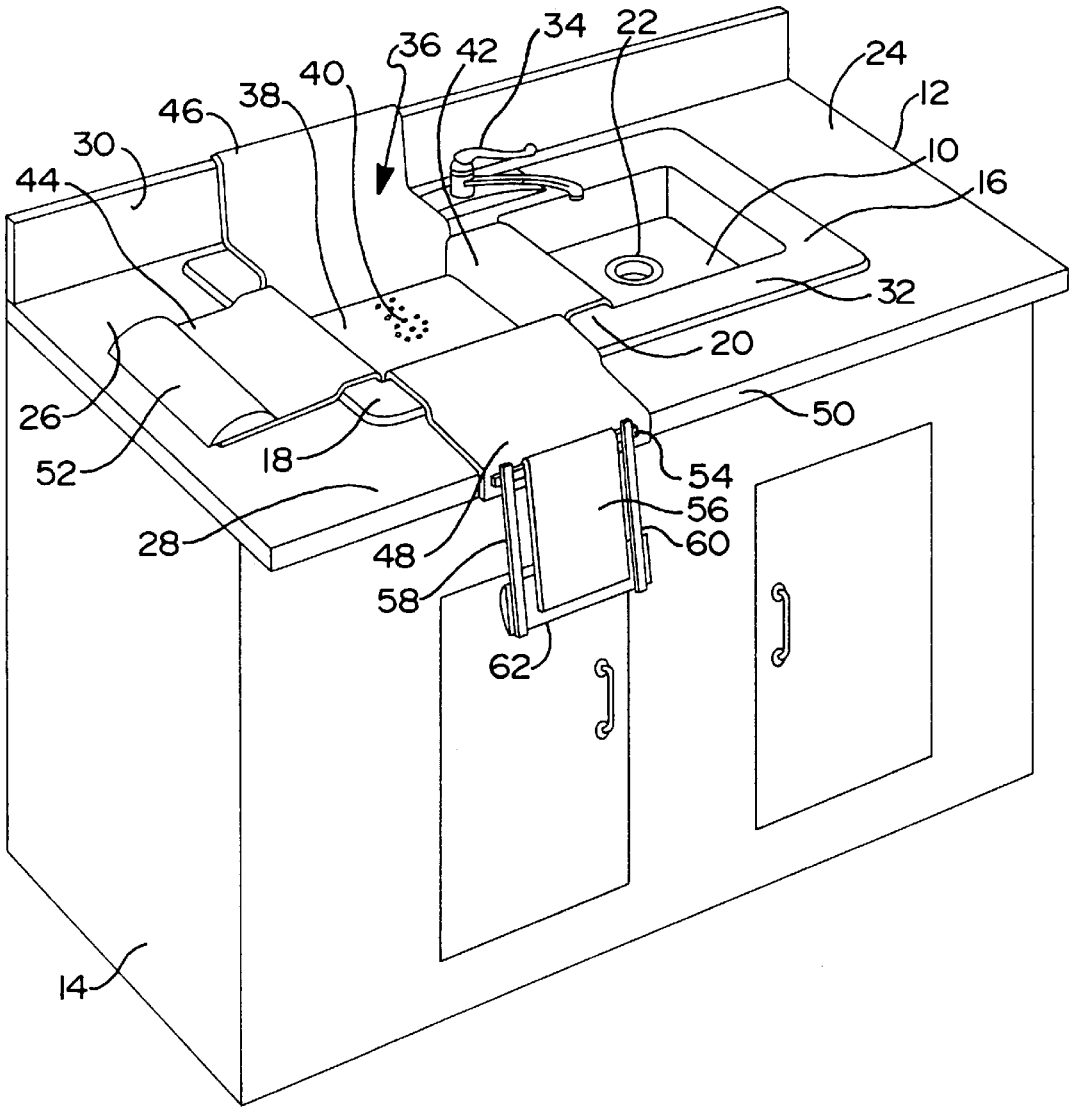
FIG. 1 is perspective view of a sink and counter fitted with a protective liner designed in accordance with the present invention.

The present invention will now be described in conjunction with the drawings beginning with FIG. 1 which shows a perspective view of a conventional sink and counter top of the type commonly used in kitchens and laundry rooms.

A double basin sink 10 is mounted within a counter top 12 of a counter and cabinet assembly 14. Sink 10 includes a first sink 16 separated from a second sink 18 by a dividing wall or partition 20. Each sink is generally rectangular in configuration in accordance with conventional construction and includes a circular drain 22. The counter top 12 includes a right side board or counter top area 24, a left side board or counter top area 26, a front apron or front counter top area 28 and a rear splash board 30. The sink 10 also includes a peripheral flange or border 32 which mounts the sink within an aperture formed in counter top 12. A standard central faucet assembly 34 is mounted on the rear peripheral border of the sink.

A protective sink and counter top liner 36 is shown seated snugly within the second sink 18 in accordance with the present invention. Liner 36 includes a central generally rectangular or square base 38 which is pressed firmly against the floor or bottom surface of the sink. Two sets of perforations 40 are formed through the base 38 for accommodating two different standard drain locations. The larger set of perforations allows drainage into drain 22 located directly beneath it.

A first or right side flap 42 extends from the right edge of the central base 38 and extends upwardly in intimate contact with the sidewall of partition 20. The right side flap 42 is dimensioned to extend up and over the partition and down and over the opposite partition wall so as to fully protect both the sides and top of partition 20.

A second or left side flap 44 extends in a similar fashion from the left edge of the central base 38 in intimate contact with the left sidewall of sink 18. The left side flap is dimensioned to extend over the peripheral border 32 of sink 10 and to further extend for a considerable distance outwardly along and over the left counter top or side board 26.

A third or rear flap 46 extends upwardly from the rear edge of the central base 38 in intimate contact with the rear sidewall of sink 18. The rear flap further extends over the peripheral border 32 and upwardly and against the splash board 30.

A fourth or front flap 48 extends upwardly from the front edge of the central base 38 in intimate contact with the front sidewall of sink 18. Flap 48 continues forwardly over the peripheral border 32 of the sink and further extends over the front counter area or apron 28 and downwardly over and beyond the front face 50 of the counter top 12. Each of the four flaps may have a surface area at least as large as that of the base.

As further seen in FIG. 1, a weight 52 is shown mounted to the free end of the outer or upper surface of the left side flap 44. Weight 52 may take the form of a pliable pouch filled with sand, bird seed or other ballast material and formed into a generally rectangular-shaped pouch, with the ballast stitched, bonded or otherwise secured therein. As discussed further below, the weight 52 may be removably secured to the left side flap 44 with buttons, hooks, snaps or other types of fasteners with the preferable fastener being a hooked and looped fabric material provided on both the flap and weight of the type sold under the brand name Velcro®.

The front flap 48 is shown provided along its outer free end with an attachment strip 54 preferably of a hooked fastening material, such as Velcro®. Attachment strip 54 may be bonded, sewn or otherwise attached to the front leading edge of the front flap 48 for detachably securing wash rags or towels such as towel 56 to the liner 36. An additional pair of attachment strips 58, 60 may be mounted at each respective top end to the outer edges of attachment strip 54 and at each respective bottom end to a weight or ballast bag 62 similar or identical to ballast bag or weight 52 noted above. The preferred manner of attachment between attachment strips 58, 60 and weight or ballast 62 is through Velcro®-type strips provided on both the attachment strips and the weight or ballast bag 62.

From a review of FIG. 1, it can be appreciated that the sink and counter top liner 36 not only protects the bottom and substantially all of the four sidewalls of the sink 18, but also covers the partition 20 as well as the major portions of the adjacent peripheral border surrounding the second sink 18. Moreover, the sink and counter top liner 36 further extends over the major portion of the left side board 26, as well as the front face and top edge of the splash board 30. In addition, the front flap 48 extends over the front counter area or apron 28 as well as the front face 50 to provide a protective surface over the top vertical front face of the counter and cabinet assembly 14 as well.

While the weight or ballast bags 52, 62 may not be needed in all cases, they do hold the flaps to which they are attached in intimate contact with the sidewalls of the sink as well as anchoring the flap to its respective counter top. The front weight 62 pulls the front flap 48 tightly against the top edge of the front wall of sink 18 and keeps the front edge of flap 48 in proper position over the front face 50 of the counter top 12. Similar tension can be manually applied to the side flaps and maintained by weight 52.

Figure 2:
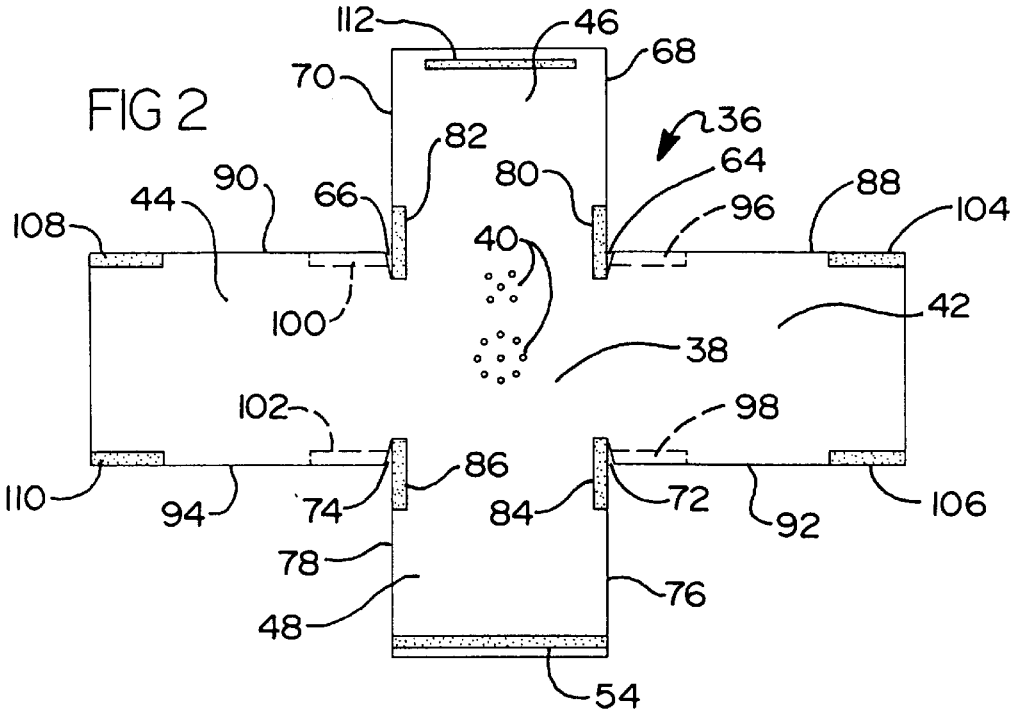
FIG. 2 is a top plan view of the liner of FIG. 1.

Details of the construction of the sink and counter top liner 36 are shown in FIGS. 2–5. As best seen in FIG. 2, the sink liner 36 when laid against a flat surface defines a generally cross-shaped configuration. Liner 36 may be formed as a single, pliable, shape-conforming stamping from a unitary sheet of plastic, rubber or other resilient waterproof material. However, it is also possible to fabricate the liner 36 from two or more rectangular mats or strips. Up to five separate rectangular mats or strips may be used with rectangular base 38 having four individual flaps attached to its respective edges by sewing, adhesive or heat bonding or other means.

In order to provide the liner as shown in flat planar form in FIG. 2 with the open-topped rectangular box-like construction shown in FIG. 1, a pattern of slits or undercuts and a corresponding series of connectors is required. More particularly, as shown in FIG. 2, a slit is formed adjacent each corner of the rectangular base 38. A first pair of slits 64, 66 is formed on the opposite sides of rear flap 46 at the point where flap 46 meets the base 38. Slits 64, 66 are generally parallel to one another and parallel to and collinear with the respective side edges 68, 70 of flap 46.

A second set of slits 72, 74 is formed at the point of intersection of front flap 48 with base 38. Slits 72, 74 are generally parallel with one another as well as generally parallel and collinear with slits 64, 66. Moreover, slits 72, 74 are also generally parallel with the side edges 76, 78 of flap 48. The slits 64, 66, 72, 74 help to define the four corners of the rectangular base when the liner is assembled.

Figure 3:
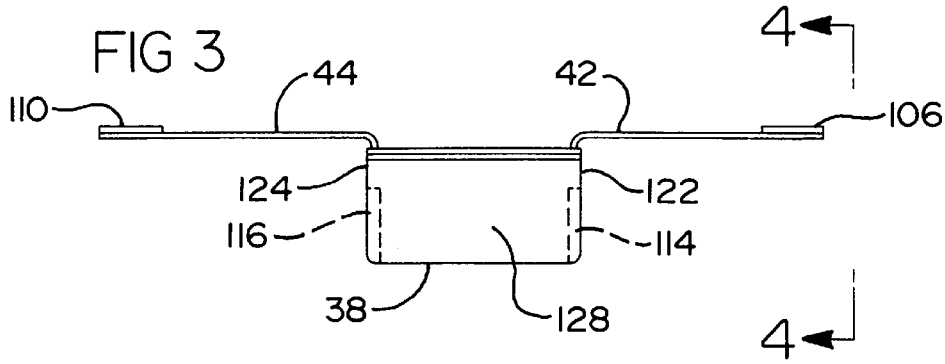
FIG. 3 is a front view of the liner of FIG. 2 in its assembled configuration with each side flap held in an elevated horizontal position for clarity.
Figure 4:
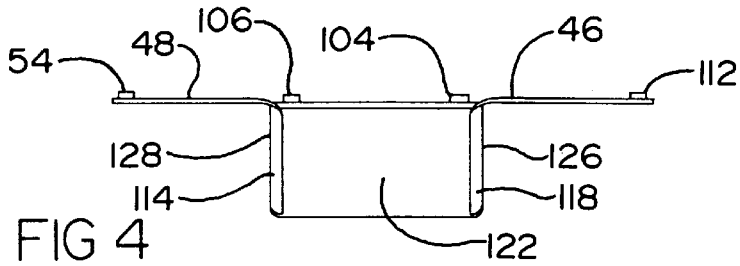
FIG. 4 is a right side view of FIG. 3.
Figure 12:
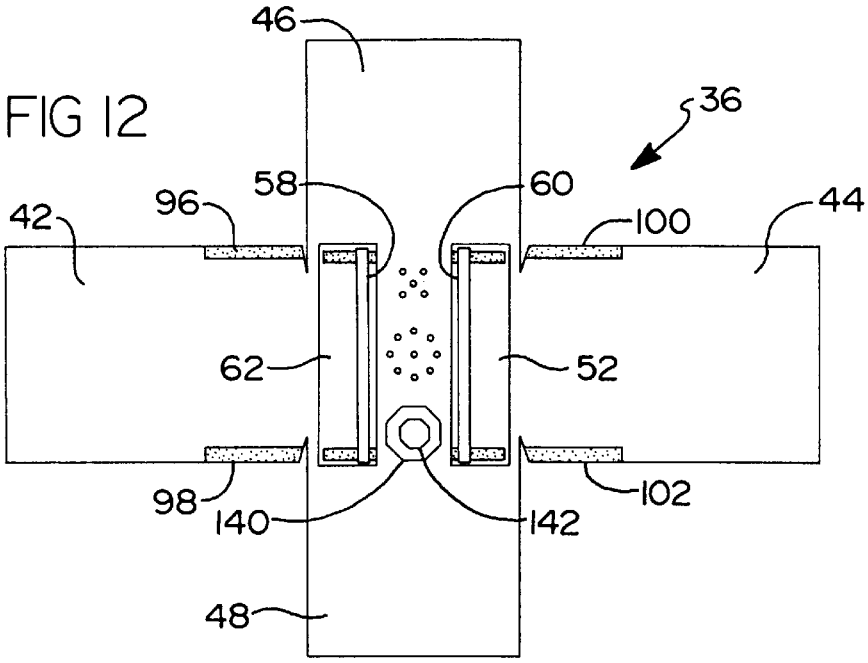
FIGS. 12–17 are top plan views of the subject invention showing the sequence and component arrangement associated with storing, folding and rolling the invention into a tightly rolled compact scroll for storage or transportation.

A pair of connectors is provided adjacent each slit to allow the flat planar liner to be folded into the box-like configuration shown in FIGS. 3–5. That is, a button, hook, snap, zipper, or hook and loop type fabric connector is provided adjacent each slit for allowing the lower or inner rear side edges of one pair of flaps, i.e. side flaps 42, 44 to be layered over the lower or inner front side edges of each adjacent flap, i.e. the front and rear flaps 48, 46 and held in position as best seen in FIG. 5.

In the embodiment shown in FIGS. 1–5, four Velcro® strips 80, 82, 84, 86 are provided in pairs on the top surface of rear flap 46 and front flap 48. The first pair of Velcro® strips 80, 82 is provided along the lower or inner edges of flap 46 parallel to each edge 68, 70 and parallel to their respective slits 64, 66. Each Velcro® strip 80, 82 extends along the full length of each slit 64, 66 and inwardly of each side surface or edge 88 of flap 42 and side edge 90 of flap 44.

In similar fashion, the other pair of attachment strips 84, 86 extend parallel to the side edges 76, 78 of front flap 48 and extend inwardly of the side edges 92 of flap 42 and 94 of flap 44, along the full length of each respective slit 72, 74.

An additional hook and loop connector strip is provided adjacent each slit 64, 66, 72, 74 but on the opposite side surface or bottom or underside of the liner 36 as shown in FIG. 2. These connectors or strips are shown in phantom in FIG. 2 and are provided as opposing pairs on the underside of flaps 42, 44. Connector strip 96 is mounted on the bottom surface of flap 42 parallel with edge 88 and generally perpendicular to strip 80 and edge 68 of flap 46. In similar fashion, connector strip 98 is provided on the under surface of flap 42 adjacent and parallel to the inner portion of edge 92 and generally perpendicular to strip 84 and edge 76 on front flap 48.

In similar fashion, connector strip 100 is provided on the inner edge of flap 44 along its under surface generally perpendicular to strip 82 and side edge 70 of flap 46 with strip 102 provided on the inner under surface of flap 44 generally parallel to edge 94 of flap 44 and generally perpendicular to strip 86 and edge 78 on front flap 48.

Additional connectors or Velcro® strips 104, 106 may be provided along the outer side edges 88, 92 of side flap 44 and in similar manner Velcro® strips 108, 110 may be provided along the outer free end edges 90, 94 of side flap 44. Strips 104, 106, 108, 110 are provided for detachably receiving one or more weights or ballast bags 52 to secure the respective flaps 42, 44 to their counter tops or within or against the sidewall or floor of an adjacent sink such as securing flap 42 against a sidewall and floor of the first sink 16 in FIG. 1. An additional connector strip of the Velcro® type may be provided along the outer edge of the rear flap 46 for detachably mounting a weight or ballast bag 52 in the case of a free-standing tub wherein all four sides are accessible such as a basin in a laundry room.

In order to form the flat planar liner 36 shown in FIG. 2 into the configuration of a generally open-topped rectangular box seen in FIGS. 1 and 3–5, strip 96 is attached to strip 80 in face to face engagement. That is, the lower edges of the side flap 42 are lifted up and over the lower edges of the rear flap 46 such that strip 96 lies coextensively over and is pressed against strip 80 and forms a detachable connection therebetween. A similar folding and pressing action is applied between strips 84, 98 along the adjacent side edges 92 of flap 42 and 76 of flap 48. Strip 98 is aligned to conform with the orientation of strip 84 and basically interengages strip 84 along its entire length.

In a similar fashion, adjacent strips 82, 100 as well as adjacent strips 86, 102 are similarly layered one upon the other and pressed together such that the hooks and loops of each respective connecting strip become interengaged. In this manner, each side corner 114, 116, 118, 120 is defined by a pair of overlapped adjacent fasteners. For example, corner 114 shown in FIG. 5 is formed by the connection of strips 84, 98 seen in FIG. 2. Similarly, corner 120 is formed by the interconnection of connector strips 82, 100

It should be noted that the inner portion of each flap 42, 44, 46, 48 forms a sidewall of the rectangular, four-sided, closed-bottomed, open-topped receptacle shown in FIGS. 1 and 5. That is, the interior portion of side flap 42 forms right sidewall 122, and in similar fashion the inner portion of the left side flap 44 forms the left sidewall 124. The inner portion of flap 46 when folded as shown in FIG. 5 forms the rear sidewall 126, and in similar fashion the inner portion of the front flap 48 forms the front sidewall 128.

Details of the ballasts or weights 52, 62 are shown in FIG. 6 wherein a pliable fabric material or sheet plastic material is folded over into a generally rectangular configuration and filled between the folds with sand, seed or other weight or ballast material and then sewn along seam line 130. A pair of fasteners such as Velcro® strips 132, 134 is provided along opposite ends of the ballast bag for removably mounting the weight to the liner such as through engagement with fastener strips 104, 106 or fastener strips 108, 110. It is also possible to attach the bag either directly to strips 54, 112 or indirectly to the strips through the use of attachment strips 58, 60 shown in FIG. 1 and shown in further detail in FIG. 7.

As seen in more detail in FIG. 7, the rear surface of attachment strip 60 is provided with a pair of hook and loop Velcro® attachment strips 136, 138 along its opposite free end portions. Strip 60 may be formed of any pliable material such as plastic or fabric.

The drain holes 40 shown in FIGS. 1–2 may be plugged using a simple patch or cover such as shown in FIG. 8. The cover 140 may cover the larger holes simply by placing it over the holes as may the cover 142 cover the smaller holes and thereby provide blockage to draining from the liner. Plugs 140, 142 may be formed of the same material as liner 36 or may be molded from a pliable waterproof material such as rubber or plastic. Although the loose plugs 140, 142 function adequately, they may be displaced due to engagement with some object being placed within or moved about the liner. Accordingly, a more durable plug assembly may be used as shown in FIG. 9–10 wherein a plug 144 having a series of perforations 146 formed therethrough is riveted to the floor or base 38 of the liner and held in place with a rivet or similar fastener 148. The plug 144 may be rotated about the rivet 148 so that its perforations 146 go into and out of registration with the perforations 40 so as to open or close the drain holes 40.

Another drain design is shown in FIG. 11 wherein a weighted drain plug assembly 150 includes a top washer 152 from which extends a hollow cylindrical tube 154. The pattern of holes 40 shown in FIGS. 1–2 is replaced with a single circular hole 156 for tightly receiving the drain plug assembly 150. The weight of the drain plug assembly helps to deform and press the base 38 downwardly into the drain 22. A manually-applied downward push on washer 152 can further depress assembly 150 into the drain to prevent drain water from seeping between the underside of base 38 and the floor of the sink or basin.

The sidewalls of tube 154 prevent excessive sideward movement of the base 38 by engaging the inner sidewalls 158 of drain 22 and help to center the liner within the sink or basin.

A plug and cap assembly 160 may be used to plug hole 156 in case the liner is used to retain liquid. An upper fitting 162 is substituted for washer 152 and nut 164 is threaded onto stem 166 from the underside of base 38 so as to sandwich the base 38 therebetween and form a watertight seal.

FIGS. 12–17 show one of several different arrangements for folding and storing the entire liner assembly along with its connecting strips, ballast bags and drain plugs. With the liner 36 arranged with its bottom surface facing up, that is the reverse as shown in FIG. 2, the ballast bags, connecting strips, drain plugs, and any other articles such as wash rags or towels, may be placed in the central base region 38.

Figure 13:
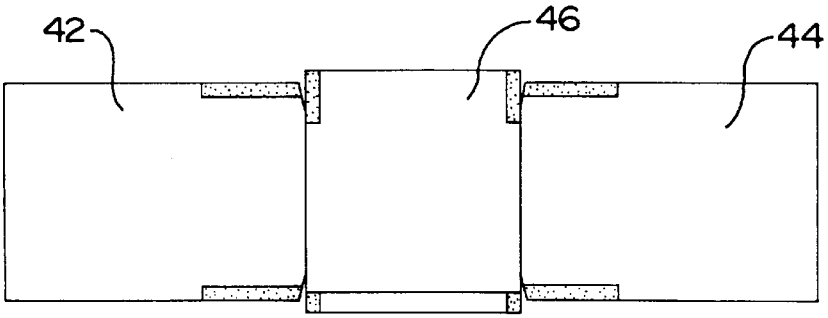
Figure 14:
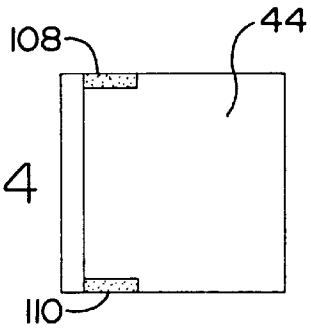
Figure 15:
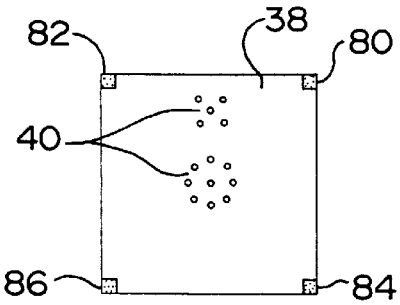
Figure 16:
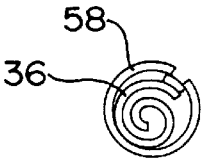

As shown in FIG. 13, the front flap 48 is first folded over the base and then the rear flap 46 is folded over the front flap. The right flap 42, shown as being on the left due to its inversion, is then folded over the base 38 followed by the left flap 44 being folded over the right flap 42. This results in a configuration shown in FIG. 14. The folded liner is then inverted and turned over thereby displaying the drain holes 40 on base 38. With the liner in the configuration shown in FIG. 15, it is rolled end over end in the manner of a bed role such as shown in FIG. 16.

Figure 17:
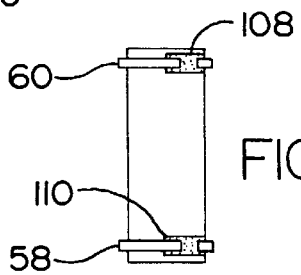

A second of pair of fastening strips 58, 60 may be used to secure the liner along with its contents in its scrolled configuration by encircling the scroll and connecting the opposite ends of the fastening strips 58, 60 to the exposed Velcro® fasteners 108, 100 as shown in FIG. 17. In this manner, the entire liner along with the contents may be transported easily in a compact fashion without loss of contents.

Although it may be expected that the hook and loop type strip fasteners which form the liner into a rectangular receptacle would allow the passage of water, it turns out that the liner will indeed hold water although a slow leak may result as the water slowly works its way through the filter-like meshed connection formed by the Velcro® strips.

In one particular embodiment, the base 38 may be formed as a square having 12-inch long sides. The top flap may also measure a 12-inch square as may the front flap with the side flaps extending laterally 18 inches and having a width of approximately 12 inches. Each of the slits adjacent the corner of the base 38 may extend for approximately 1 inch into each side flap. Each of the Velcro® strips provided along the inner edges of the flaps both on the front and back surfaces may extend for approximately 5 inches. The ballast bags may weigh 1–2 pounds each and extend over a length of about 12 inches with each of the attachment strips also extending for a length of about 12 inches.

There has been disclosed heretofore the best embodiment of the invention presently contemplated. However, it is to be understood that various changes and modifications may be made thereto without departing from the spirit of the invention.

What is claimed is:

1. A mat for protecting a rectangular sink floor, four sink sidewalls and four surface areas surrounding said four sidewalls, said mat comprising:

a pliable, shape-conforming cross-shaped liner comprising a rectangular base dimensioned with a surface area sufficient to cover said sink rectangular floor and four flaps connected to and extending outwardly from said base, said four flaps each dimensioned with a surface area at least equal to the surface area of said base and sufficient to cover a substantial portion of each respective sidewall and to extend over and above each sidewall and cover said four surface areas surrounding said sink sidewalls.

2. The mat of claim 1, wherein each one of said four flaps comprises a rectangular flap having one side connected to one respective side of said rectangular base.

3. The mat of claim 1, further comprising a pair of fasteners provided on each one of said four flaps.

4. The mat of claim 3, wherein each one of said fasteners is provided adjacent said rectangular base.

5. The mat of claim 1, further comprising a pair of fasteners provided adjacent each corner of said rectangular base.

6. The mat of claim 5, wherein one of each said pair of fasteners is provided on one of said four flaps and the other one of each said pair of fasteners is provided on an adjacent one of said four flaps.

7. The mat of claim 6, wherein said mat comprises a front surface and a rear surface and wherein said one of each said pair of fasteners is provided on said front surface and wherein said other one of each said pair of fasteners is provided on said rear surface.

8. The mat of claim 1, further comprising a plurality of perforations formed in said base for allowing drainage through said mat.

9. The mat of claim 8, further comprising a rotatable stopper disposed over said perforations for selectively allowing said drainage.

10. The mat of claim 8, wherein said plurality of perforations comprises two sets of spaced apart perforations.

11. The mat of claim 1, further comprising at least one hook and loop type fastener strip provided on at least one of said four flaps for detachably securing towels thereto.

12. The mat of claim 11, further comprising a pair of attachment strips removably connected at one end to said at least one fastener strip, and a weight removably connected to the other end of said pair of attachment strips.

13. The mat of claim 1, further comprising four slits formed in said mat with one of said slits formed adjacent each corner of said rectangular base.

14. The mat of claim 13, wherein each one of said slits is parallel with each other one of said slits.

15. The mat of claim 1, further comprising a drain port formed in said base, and a removable stopper fitted into said drain port.

16. A mat for protecting a sink floor, four sink sidewalls and four surface areas surrounding said four sidewalls, said mat comprising:

a pliable, shape-conforming liner comprising a rectangular base dimensioned to cover said sink floor and four flaps connected to and extending outwardly from said base, said four flaps each dimensioned to cover a substantial portion of each respective sidewall and to extend over and above each sidewall and cover said four surface areas surrounding said sink sidewalls, and wherein said mat is folded into a four-sided generally rectangular receptacle having a bottom formed by said base, four sidewalls formed by a portion of said four flaps and defining an open top, with the remainder of said flaps respectively extending outwardly from said sidewalls for protecting said surface areas surrounding said four sidewalls, and four closed corners each extending from said bottom to said open top and each defined by overlapping portions of adjacent sidewalls.

17. A mat for protecting a sink floor, four sink sidewalls and four surface areas surrounding said four sidewalls, said mat comprising:

a pliable, shape-conforming liner comprising a rectangular base dimensioned to cover said sink floor and four flaps connected to and extending outwardly from said base, said four flaps each dimensioned to cover a substantial portion of each respective sidewall and to extend over and above each sidewall and cover said four surface areas surrounding said sink sidewalls, and a weight removably mounted to said mat and provided on at least one of said four flaps.

18. The mat of claim 17, wherein said at least one of said four flaps comprises a free end portion having a connector provided thereon, wherein said weight comprises a connector provided thereon and wherein said weight is removably mounted to said flap via said connectors.

19. The mat of claim 17, wherein said weight comprises a pouch filled with ballast material.

* * * * *